US006668772B2

(12) United States Patent
Muraji

(10) Patent No.: US 6,668,772 B2
(45) Date of Patent: Dec. 30, 2003

(54) LINEAR ACTUATOR APPARATUS AND ACTUATING CONTROL METHOD

(75) Inventor: Tetsuo Muraji, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/347,267

(22) Filed: Jan. 21, 2003

(65) Prior Publication Data

US 2003/0136363 A1 Jul. 24, 2003

(30) Foreign Application Priority Data

Jan. 21, 2002 (JP) ..... 2002-011884

(51) Int. Cl.[7] ..... F01L 9/04

(52) U.S. Cl. ..... 123/90.11; 251/129.1; 251/129.19; 251/129.09

(58) Field of Search ..... 123/90.11; 251/129.1, 251/129.19, 129.09; 335/220, 229

(56) References Cited

U.S. PATENT DOCUMENTS 5,611,303 A * 3/1997 Izuo ..... 123/90.11
5,692,463 A * 12/1997 Liang et al. ..... 123/90.11
5,730,091 A * 3/1998 Diehl et al. ..... 123/90.11
6,003,481 A 12/1999 Pischinger et al.
6,349,685 B1 * 2/2002 Kolmanovsky et al. .. 123/90.11

FOREIGN PATENT DOCUMENTS

| | | |
|---|---|---|
| EP | 0569088 A1 | 11/1993 |
| EP | 1045116 A1 | 10/2000 |
| JP | 4-67005 | 10/1992 |
| JP | 2000-199411 | 7/2000 |
| WO | 02/064960 | 8/2002 |
| WO | 02/37006 | 10/2002 |

* cited by examiner

*Primary Examiner*—Thomas Denion
*Assistant Examiner*—Zelalem Eshete
(74) *Attorney, Agent, or Firm*—Wenderoth, Lind & Ponack, L.L.P.

(57) ABSTRACT

When an inlet valve is opened or closed via a first mover, by the operation of a first linear actuator, energy accumulated by a first spring or a second spring is discharged by the operation of a second linear actuator, to transmit the energy to the inlet valve via a second mover and the first mover. As a result, the inlet valve can be opened or closed at a high speed, with higher energy efficiency and has an improved durability.

16 Claims, 10 Drawing Sheets

INITIAL STATE

INITIAL STATE

HOLDING CLOSED STATE

OPENING OPERATION
(FINISH ACCELERATION)

HOLDING OPEN STATE

CLOSED OPERATION

LINEAR ACTUATOR APPARATUS AND ACTUATING CONTROL METHOD

BACKGROUND OF THE INVENTION

1) Field of the Invention

The present invention relates to improving the speed of linear reciprocating movement of a load, the energy efficiency, and durability of a liner actuator apparatus. The load is, for example, an inlet valve, an exhaust valve, or a fuel injection valve of an automobile gasoline engine.

2) Description of the Related Art

A prior art linear actuator apparatus is disclosed in, for example, Japanese Patent Application Laid-Open No. 2000-199411. This linear actuator apparatus is used as an actuating apparatus that linearly reciprocates to open or close the inlet valve or the exhaust valve of the automobile gasoline engine.

The configuration of this prior art linear actuator apparatus will be explained in detail below. The linear actuator has an actuating unit. The actuating unit includes a magnetic path member comprising a magnetic flux generator equipped with an electromagnetic coil by winding to generate a magnetic flux; and a magnetic field forming section that has at least two pole shoes to form at least one magnetic field region by distributing the magnetic flux. The linear actuator further has a magnetizing member fitted to a mover and having two magnetized surfaces having a different magnetic polarity from each other; an electric current supply unit that supplies a driving current having a magnetism corresponding to either the outward direction or the inward direction of the first mover, to the electromagnetic coil; and a valve stem and a valve element integral with the mover.

The linear actuator apparatus operates as explained below. When the current is not supplied to the electromagnetic coil, the valve element is located at a predetermined position (reference position). When a direct current flowing in a predetermined direction is supplied to the electromagnetic coil, the valve element moves in the predetermined direction and is located at an open position, corresponding to the size of the magnetic flux density. Further, when a direct current flowing in a direction opposite to the predetermined direction is supplied to the electromagnetic coil, the valve element moves in a direction opposite to the predetermined direction and is located at a closed position, corresponding to the size of the magnetic flux density.

SUMMARY OF THE INVENTION

The present invention relates to an improvement in the linear actuator apparatus.

The linear actuator apparatus, which linearly reciprocate a load, according to one aspect of the present invention has a first linear actuator including a first mover capable of linearly reciprocating in a first direction and a second direction, the first mover being connected to the load; a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction. The shift of the first mover is larger than that of the second mover. Moreover, the accumulator has a structure such that the accumulator accumulates energy by the shift of the second mover in one of the first direction and the second direction, and shifts the second mover in other one of the first direction and the second direction by discharging the accumulated energy, and the first mover and the second mover have an abutting surface, respectively, which abuts against each other when the accumulator accumulates or discharges energy, to thereby transmit energy to each other via the accumulator.

The linear actuator apparatus, which linearly reciprocate a load, according to an another aspect of the present invention has a first linear actuator including a first mover capable of linearly reciprocating in a first direction and a second direction, the first mover being connected to the load; a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction. The shift of the first mover is larger than that of the second mover. Moreover, the accumulator includes a first accumulator having a structure such that it accumulates energy by the shift of the second mover in the first direction due to the operation of the second linear actuator, and shifts the second mover in the second direction by discharging the energy accumulated by the operation of the second linear actuator; and a second accumulator having a structure such that it accumulates energy by the shift of the second mover in the second direction due to the operation of the second linear actuator, and shifts the second mover in the first direction by discharging the energy accumulated by the operation of the second linear actuator. In addition, the first mover and the second mover respectively include a first abutting surface that abuts against each other when the second mover shifts in the second direction due to the discharge of energy by the first accumulator, to transmit the energy discharged from the first accumulator to the load; and a second abutting surface that abuts against each other when the second mover shifts in the first direction due to the discharge of energy by the second accumulator, to transmit the energy discharged from the second accumulator to the load.

The actuating control method according to still another aspect of the present invention is realized on the linear actuator apparatuses according to the above-mentioned aspects of the present invention and comprises, at the time of startup, actuating the second linear actuator to shift the second mover in one of the first direction and the second direction and actuating the first linear actuator to shift the first mover in the same direction in which the second linear actuator is actuated.

The actuating control method according to still another aspect of the present invention is realized on the linear actuator apparatuses according to the above-mentioned aspects of the present invention and comprises damping the shift of the first mover by the action of the accumulator for accumulating the energy and by controlling the actuation of the second linear actuator.

These and other objects, features and advantages of the present invention are specifically set forth in or will become apparent from the following detailed descriptions of the invention when read in conjunction with the accompanying drawings.

DETAILED DESCRIPTIONS

Exemplary embodiment(s) of the linear actuator apparatus and the actuating control method, according to the present invention, is explained, with reference to the accompanying drawings. The linear actuator apparatus according to this embodiment is used, for example, as an actuating apparatus that linearly reciprocates, that is, opens or closes an inlet valve of an automobile gasoline engine. However, the present invention is not limited to the embodiment. FIGS. 1 to 10 shows the linear actuator apparatus according to the embodiment(s) of the present invention.

Explanation of Overall Structure

Figure 1:
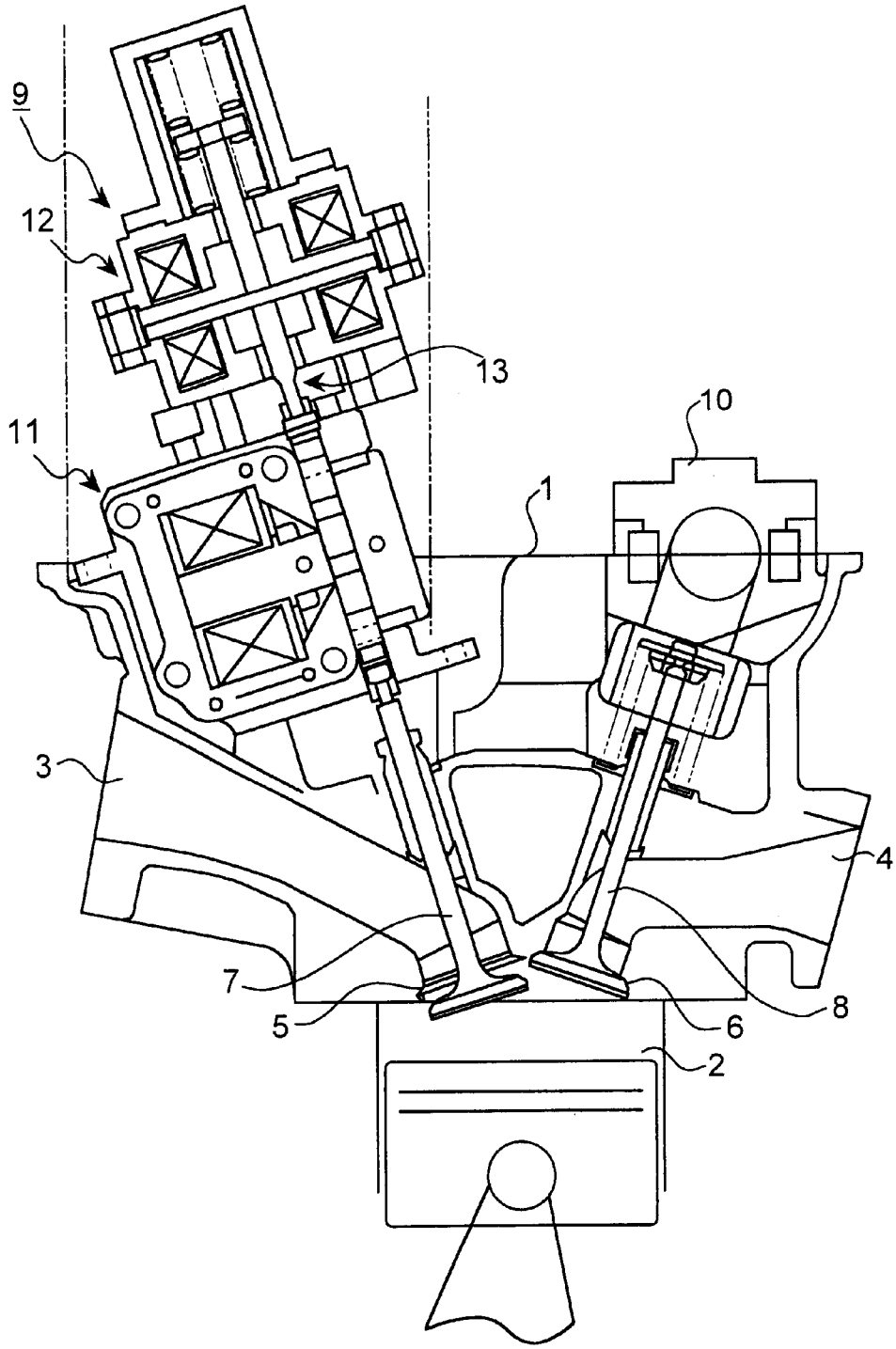
FIG. 1 is a cross section of relevant parts of a linear actuator apparatus according to an embodiment of the present invention.

In FIG. 1, reference sign 1 denotes a cylinder head in an automobile gasoline engine. A combustion chamber 2, an inlet path 3, and an exhaust path 4 are respectively provided in the cylinder head 1. An inlet port 5 is provided between the combustion chamber 2 and the inlet path 3, and an exhaust port 6 is provided between the combustion chamber 2 and the exhaust path 4.

An inlet valve 7 and an exhaust valve 8 are respectively equipped in the cylinder head 1, so that opening and closing movement is possible. Further, the linear actuator apparatus 9 according to the embodiment and a cam mechanism 10 are also equipped in the cylinder head 1, respectively.

The inlet valve 7 is connected to the linear actuator apparatus 9. The inlet valve 7 shifts to open or close the inlet port 5, by the actuating control of the linear actuator apparatus 9. In other words, the inlet valve 7 is a direct-acting valve, whose 1 opening and closing movement is directly controlled by the linear actuator apparatus 9.

On the other hand, the exhaust valve 8 is connected to the cam mechanism 10. The exhaust valve 8 opens and closes the exhaust port 6 by the opening and closing movement due to the rotation of a cam in the cam mechanism 10. The cam mechanism 10 is constructed such that the cam rotates synchronously with the rotation of a crank-shaft (not shown) in the automobile gasoline engine.

The linear actuator apparatus 9 comprises a first linear actuator 11, a second linear actuator 12, and a connecting unit 13. The first linear actuator 11 and the second linear actuator 12 are respectively a linear actuator of an electromagnet type.

Explanation of the First Linear Actuator 11

Figure 2:
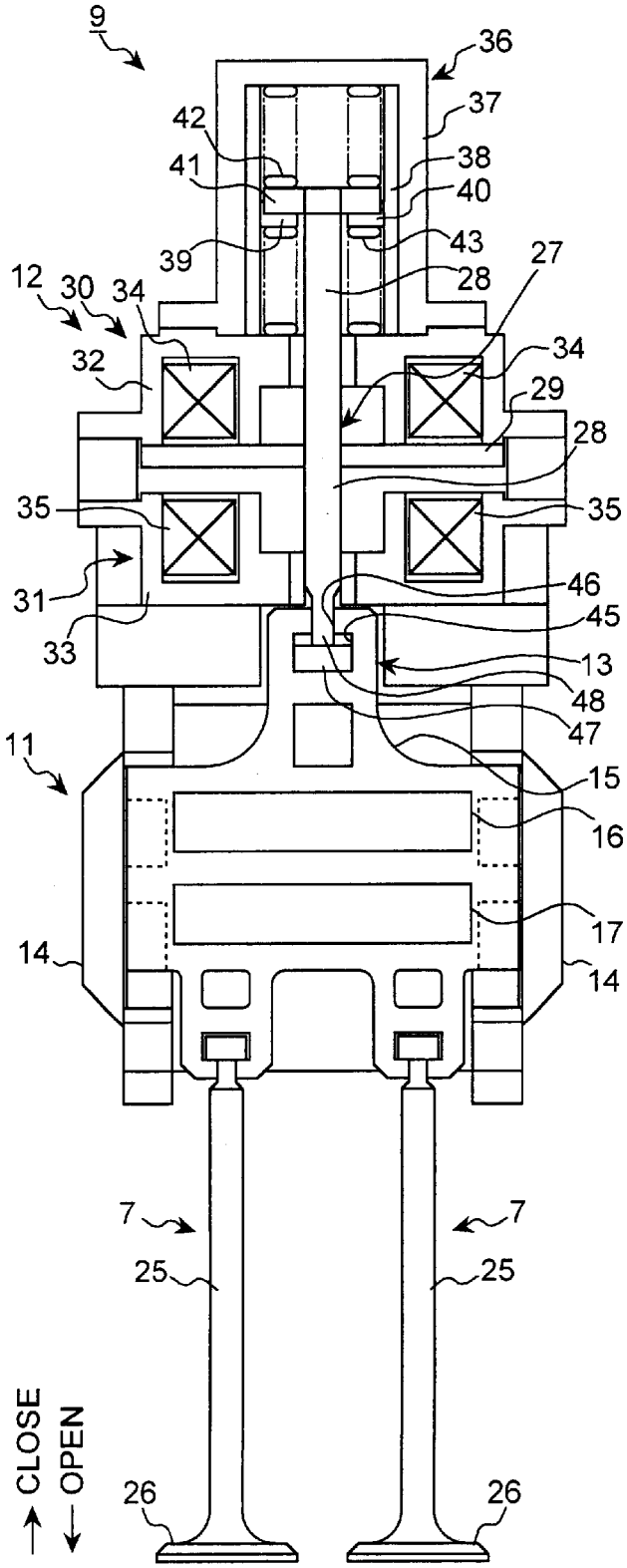
FIG. 2 is a cross section, in a different direction as compared to that of FIG. 1, of relevant parts of the linear actuator apparatus according to the present invention.
Figure 3:
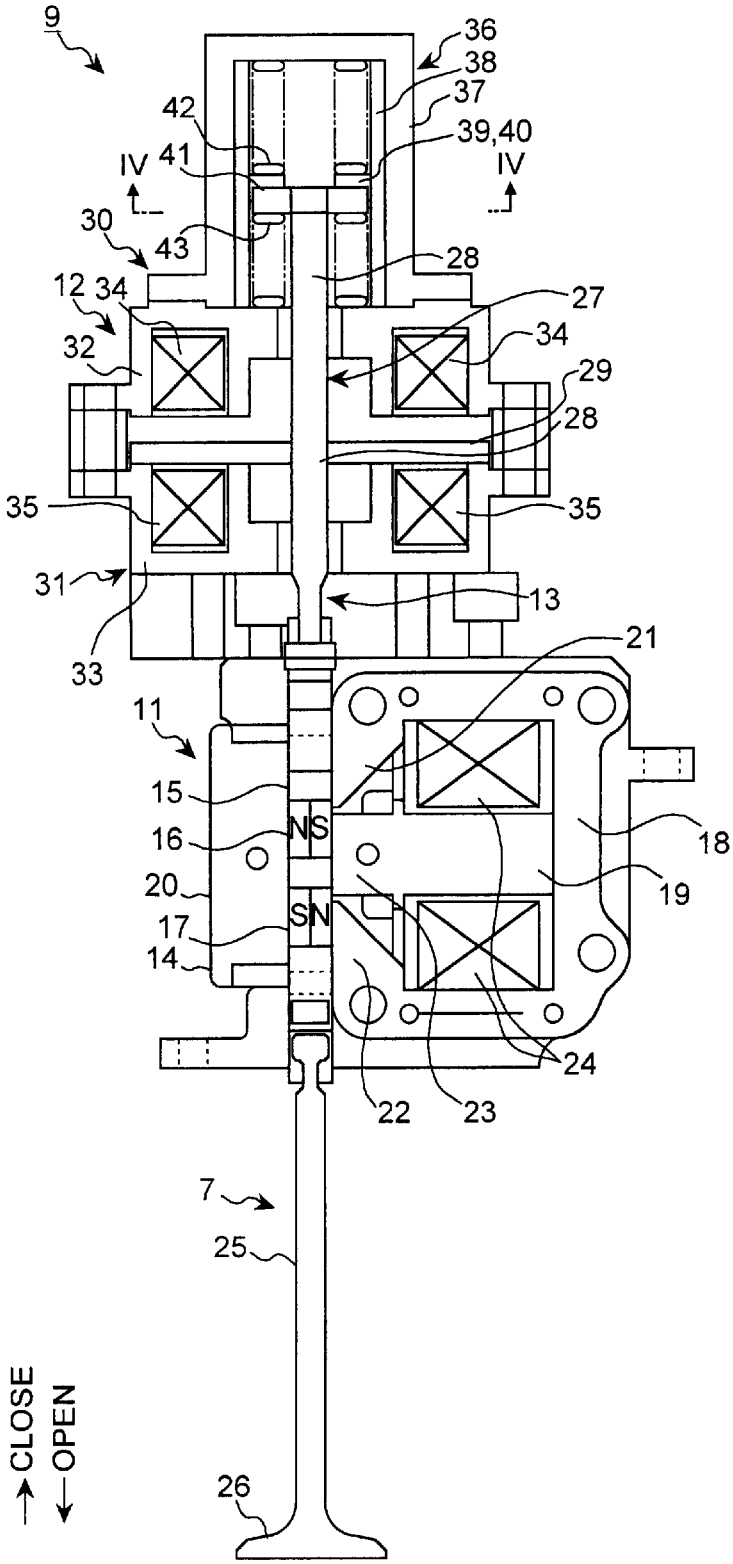
FIG. 3 is a cross section, in a different direction as compared to that of FIG. 1, of relevant parts of the linear actuator apparatus according to the present invention.

As the first linear actuator 11, for example, one described in Japanese Patent Application Laid-Open No. 2000-199411 is used. As shown in FIG. 2 and FIG. 3, the first linear actuator 11 has a holder 14. The holder 14 holds the first mover 15 so as to be able to linearly reciprocate, that is, so as to enable opening and closing movement. In the figure, "arrow open" indicates the opening direction, that is, the outward direction, and "arrow close" indicates the closing direction, that is, the inward direction.

Two fixed holes (through holes) are provided in the first mover 15, with a space therebetween in the opening and closing direction. Two magnets 16 and 17 are respectively fixed to the two fixed holes. The both sides of the two magnets 16 and 17 are substantially on the same plane with the both sides of the first mover 15. The both sides of the two magnets 16 and 17 are respectively formed by magnetization on two magnetized surfaces having a different polarity from each other. In other words, as shown in FIG. 3, the left magnetized surface of the first magnet 16 is magnetized in the N pole, the right magnetized surface of the first magnet 16 is magnetized in the S pole, the left magnetized surface of the second magnet 17 is magnetized in the S pole, and the right magnetized surface of the second magnet 17 is magnetized in the N pole.

A first yoke 18 in a C-shape, a core 19, and a second yoke 20 in a plate form are respectively fixed on the holder 14. The two magnets 16 and 17 in the first mover 15 are arranged so as to enable opening and closing movement, between the first yoke 18, the core 19, and the second yoke 20, respectively.

Three pole shoes 21, 22, and 23 are respectively arranged on the both sides of the first yoke 18 and the core 19, in the opening and closing direction of the first mover 15. A current supply unit (not shown) is electrically connected to the electromagnetic coil 24.

The core 19 forms a magnetic flux generator equipped with the electromagnetic coil 24 by winding to generate a magnetic flux. The vicinity of the pole shoes 21 and 23, and the vicinity of the pole shoes 22 and 23 form two magnetic field regions. The first yoke 18 has at least two pole shoes (in this example, three pole shoes 21, 22, 23), to distribute the magnetic flux, and constitutes a magnetic field forming section, which forms at least one (in this example, two) magnetic field region. The second yoke 20 constitutes a magnetic path member. The two magnets 16 and 17 constitute a magnetizing member provided corresponding to the two magnetic field regions.

Two inlet valves 7 as the load are connected to one end of the first mover 15. The inlet valve 7 comprises a valve shaft 25, and a valve element 26 formed integrally at one end of the valve shaft 25. The other end of the valve shaft 25 is fixed to one end of the first mover 15.

Figure 5:
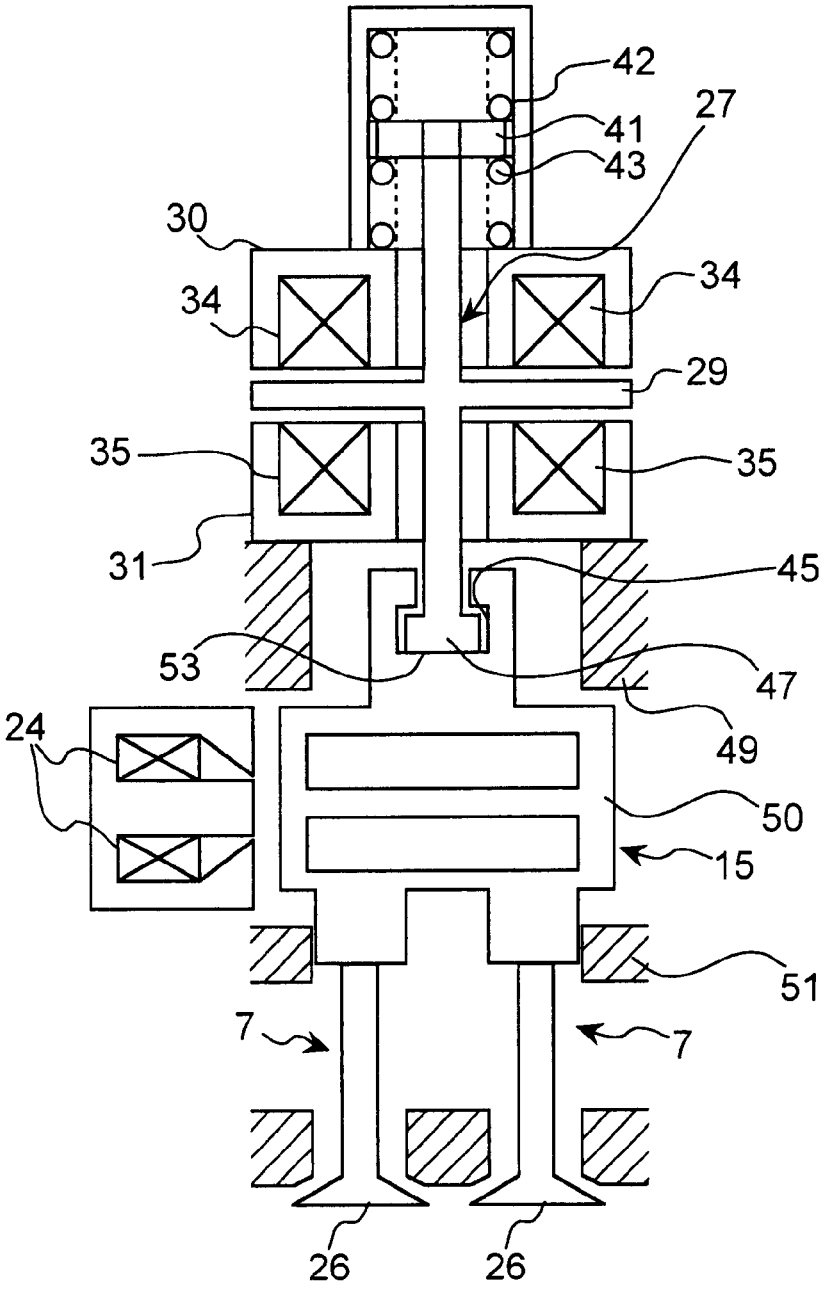
FIG. 5 is a cross section that shows the initial state in FIG. 3.

When the electric current is not supplied to the electromagnetic coil 24, as shown in FIG. 5, the valve element 26 is located at a predetermined position (reference position, in the initial state). When a direct current flowing in a predetermined direction is supplied to the electromagnetic coil 24, the valve element 26 moves in the opening direction, corresponding to the magnitude of the magnetic flux density. Further, when a direct current flowing in a direction opposite to the predetermined direction is supplied to the electromagnetic coil 24, the valve element 26 moves in the closing direction, corresponding to the size of the magnetic flux density. The size of the direct current to be supplied is substantially in proportion to the size of a driving force at the time of shifting the first mover 15 (and the inlet valve 7) so as to open or close.

Explanation of the Second Linear Actuator 12

As shown in FIG. 2 and FIG. 3, a second mover 27 is equipped in the second linear actuator 12, so as to enable the opening and closing movement in the same direction as that of the first mover 15. The second mover 27 comprises a rod 28, and an armature 29 integrally formed with the rod 28 in the intermediate thereof.

The second linear actuator 12 comprises a first solenoid 30 and a second solenoid 31. The first solenoid 30 comprises a first core 32 and a first coil 34 wound on the first core 32, and the second solenoid 31 comprises a second core 33 and a second coil 35 wound on the second core 33. The armature 29 of the second mover 27 is arranged between the first solenoid 30 and the second solenoid 31, so as to enable the opening and closing movement.

The first solenoid 30 is excited by energizing the first coil 34, to shift the second mover 27 (the first mover 15 and the inlet valve 7) in the closing direction, and allows the second mover 27 (the first mover 15 and the inlet valve 7) to be held at the shifted closing position. The first solenoid 30 is demagnetized by de-energizing the first coil 34, to release the holding state of the second mover 27 (the first mover 15 and the inlet valve 7) at the closing position.

On the other hand, the second solenoid 31 is excited by energizing the second coil 35, to shift the second mover 27 (the first mover 15 and the inlet valve 7) in the opening direction, and allows the second mover 27 (the first mover 15 and the inlet valve 7) to be held at the shifted opening position. The second solenoid 31 is demagnetized by de-energizing the second coil 35, to release the holding state of the second mover 27 (the first mover 15 and the inlet valve 7) at the opening position.

An accumulator 36 is equipped on the second mover 27. The accumulator 36 has a casing 37 having a hollow cylindrical shape with one end (lower end) being open, and the other end (upper end) being closed. The lower end of the casing 37 is fixed on the second core 33. A middle casing 38 in a hollow cylindrical shape is fixed in the casing 37, with the opposite ends being open. A partition board 39 is integrally formed in the intermediate of the middle casing 38.

Figure 4:
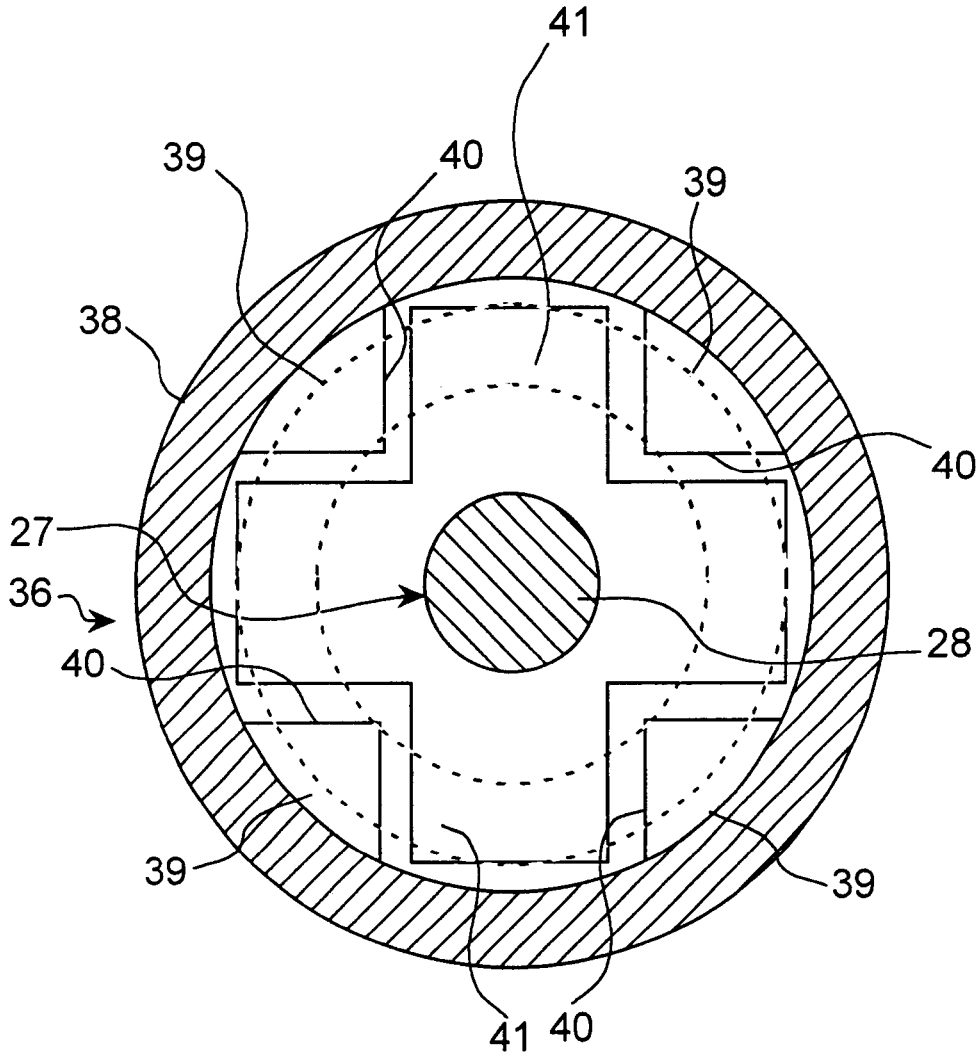
FIG. 4 is a cross section taken along line IV—IV in FIG. 3.

As shown in FIG. 4, the partition board 39 is provided with a cruciate hole 40. On the other hand, a cruciate push plate 41 is fixed at one end of the rod 28 of the second mover 27. The push plate 41 can pass through the hole 40.

A first spring 42 as a first accumulator is arranged between the upper end of the casing 37 and the partition board 39. A second spring 43 as a second accumulator is arranged between the second core 33 and the partition board 39.

The first spring 42 is for accumulating energy by compression due to the shift of the second mover 27 (the first mover 15 and the inlet valve 7) in the closing direction, and for shifting the second mover 27 (the first mover 15 and the inlet valve 7) in the opening direction by discharging the energy by expansion. The second spring 43 is for accumulating energy by compression due to the shift of the second mover 27 (the first mover 15 and the inlet valve 7) in the opening direction, and for shifting the second mover 27 (the first mover 15 and the inlet valve 7) in the closing direction by discharging the energy by expansion.

The cross section of the wire of the first spring 42 and the second spring 43 is elliptic, as shown in FIGS. 1 to 3. The cross section of the wire of the springs 42 and 43 may be circular, as shown in FIGS. 5 to 9.

Explanation of the Connecting Unit 13

The other end of the first mover 15 and the other end of the first mover 27 are connected to each other via the connecting unit 13, so as to be able to move relative to each other in the opening and closing direction. In other words, as shown in FIG. 2, an engagement hole 45 having a large inner size and a through groove 46 having a small inner size are respectively provided at the other end of the first mover 15. An engagement protrusion 47 having a large external size and a penetrating portion 48 having a small external size are respectively provided at the other end of the rod 28 of the second mover 27. The engagement protrusion 47 is engaged in the engagement hole 45 so as to be able to move in the opening and closing direction. Similarly, the penetrating portion 48 penetrates through the through groove 46 so as to be able to move in the opening and closing direction.

Figure 6:
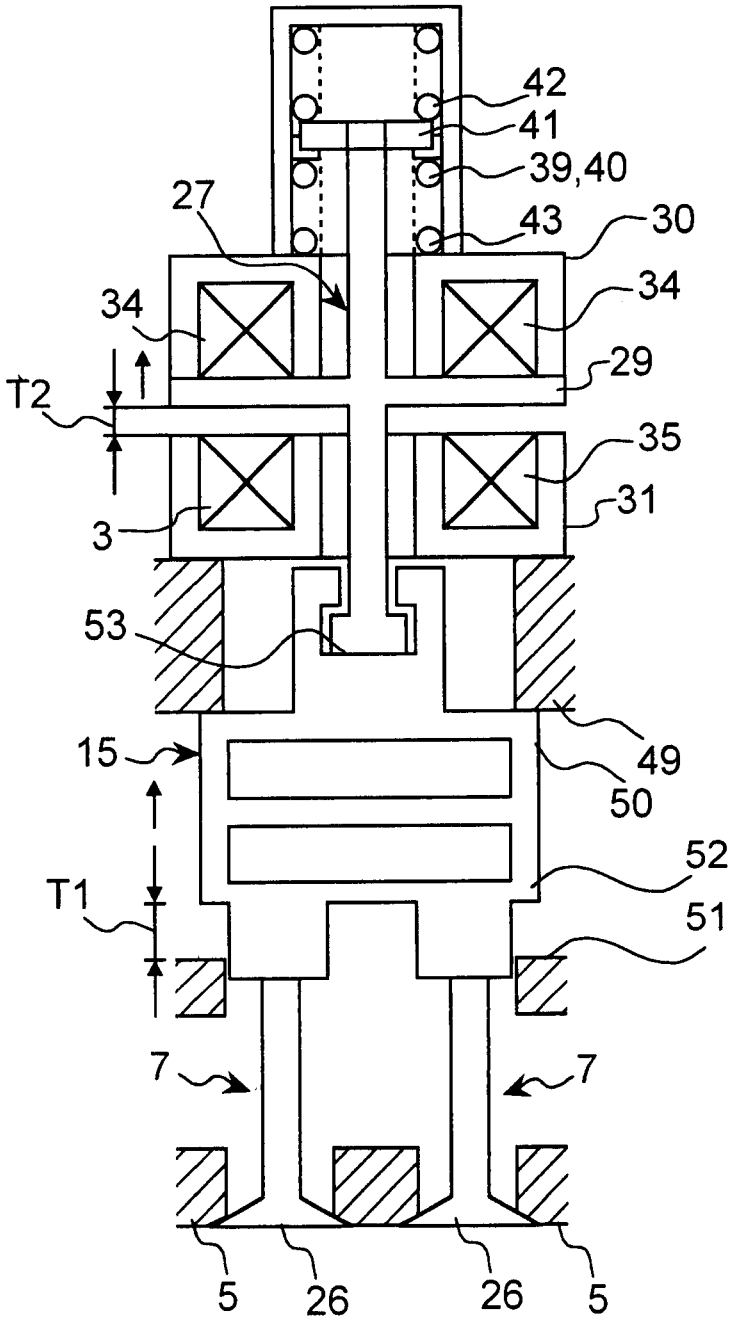
FIG. 6 is a cross section that shows the closed holding state in FIG. 3.
Figure 7:
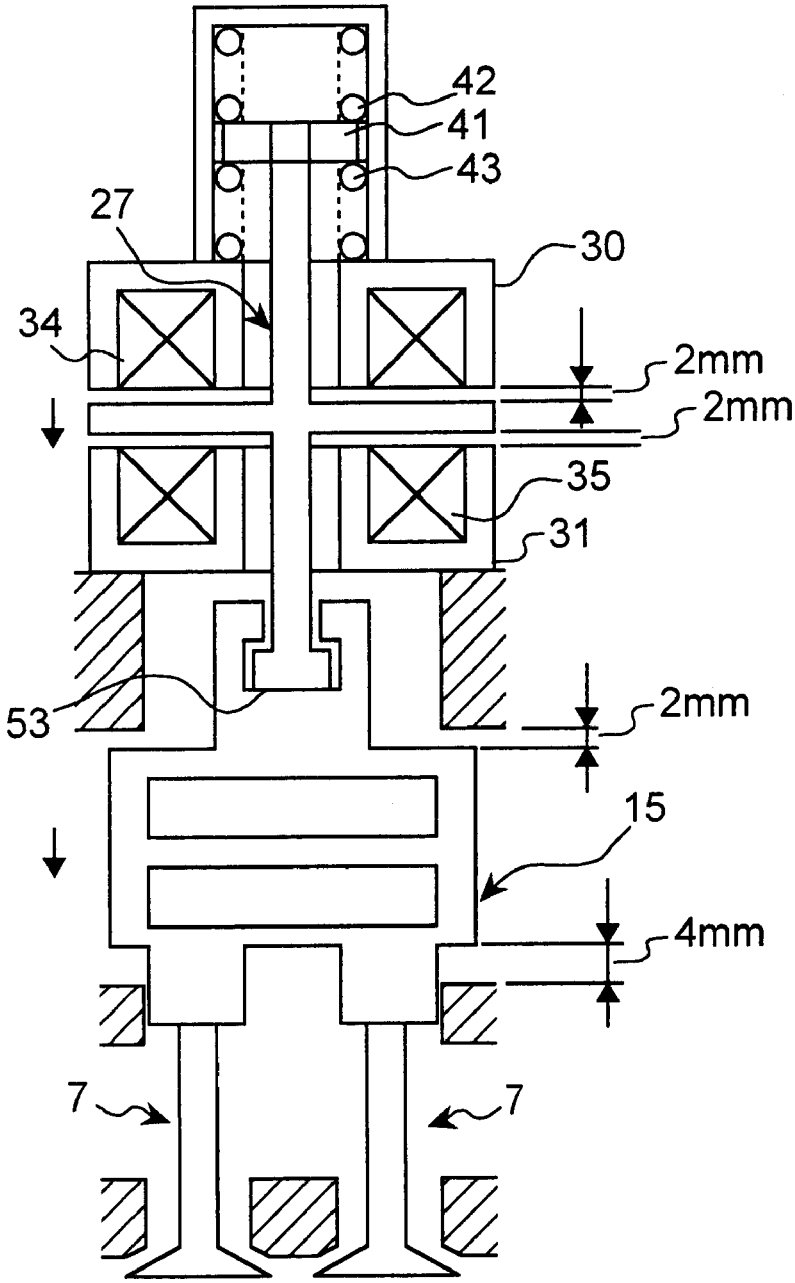
FIG. 7 is a cross section that shows the open operation state in FIG. 3.
Figure 8:
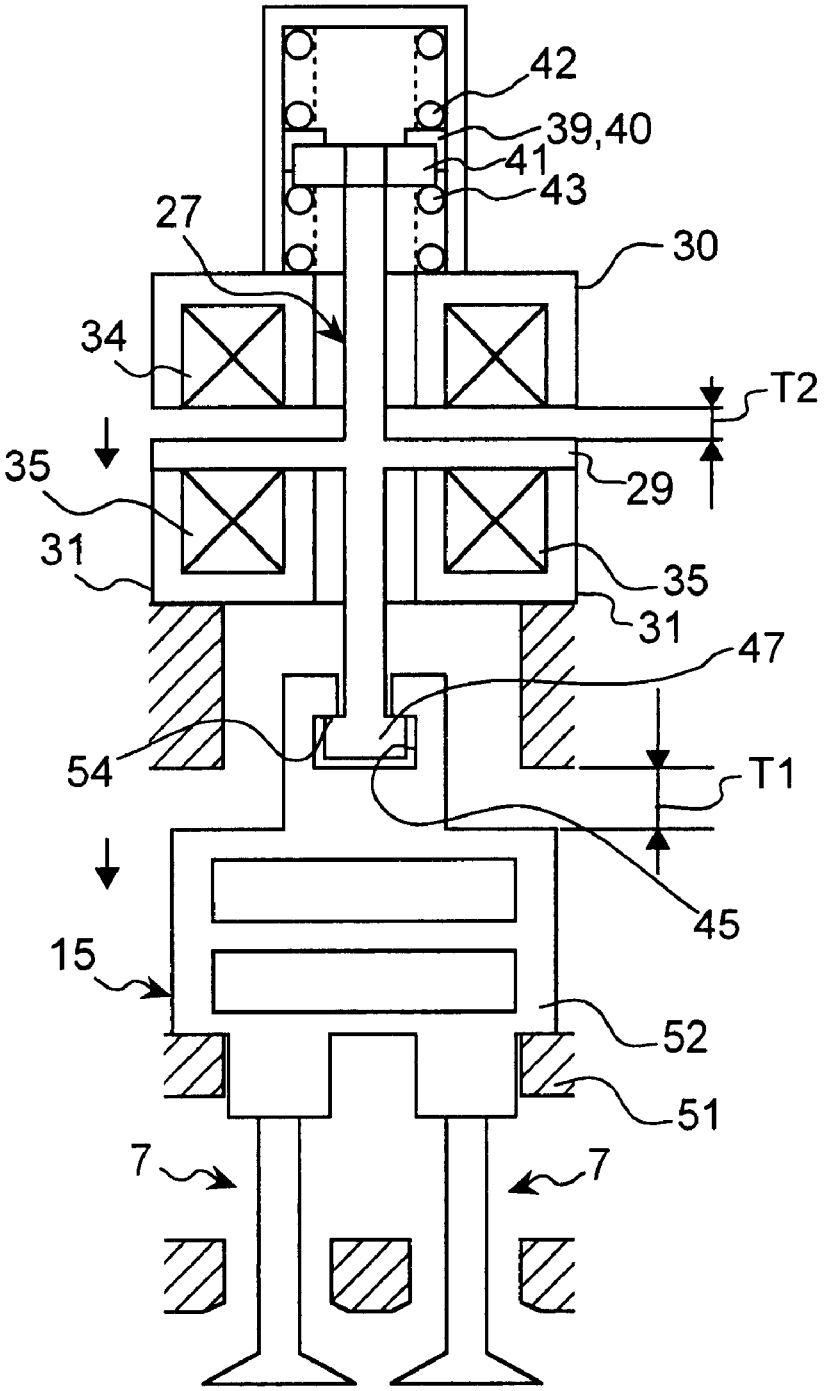
FIG. 8 is a cross section that shows the open holding state in FIG. 3.

As shown in FIGS. 5 to 9, the first mover 15 can shift for opening and closing with respect to the holder 14, between the position where first stoppers 49 and 50 abut against each other (see FIG. 6) and the position where second stoppers 51 and 52 abut against each other (see FIG. 8). The second mover 27 can shift for opening and closing with respect to the second linear actuator 12, between the position where the armature 29 abuts against the first solenoid 30 (see FIG. 6) and the position where the armature 29 abuts against the second solenoid 31 (see FIG. 8).

The shift of the first mover 15 is a distance T1 between the second stoppers 51 and 52 (see FIG. 6) in the state that the first stoppers 49 and 50 abut against each other, or a distance T1 (see FIG. 8) between the first stoppers 49 and 50 (see FIG. 6) in the state that the second stoppers 51 and 52 abut against each other. The shift of the second mover 27 is a distance T2 between the armature 29 and the second solenoid 31 (see FIG. 6) in the state that the armature 29 abuts against the first solenoid 30, or a distance T2 (see FIG. 8) between the armature 29 and the first solenoid 30 (see FIG. 6) in the state that the armature 29 abuts against the second solenoid 31.

The shift T1 of the first mover 15 is larger than the shift T2 of the second mover 27. In this example, the shift T1 of the first mover 15 is 6 mm, and the shift T2 of the second mover 27 is 4 mm. As a result, the other end of the first mover 15 and the other end of the second mover 27 can move relative to each other in the opening and closing direction in the connecting unit 13, by a difference of the shifts T1−T2=2 mm.

Figure 9:
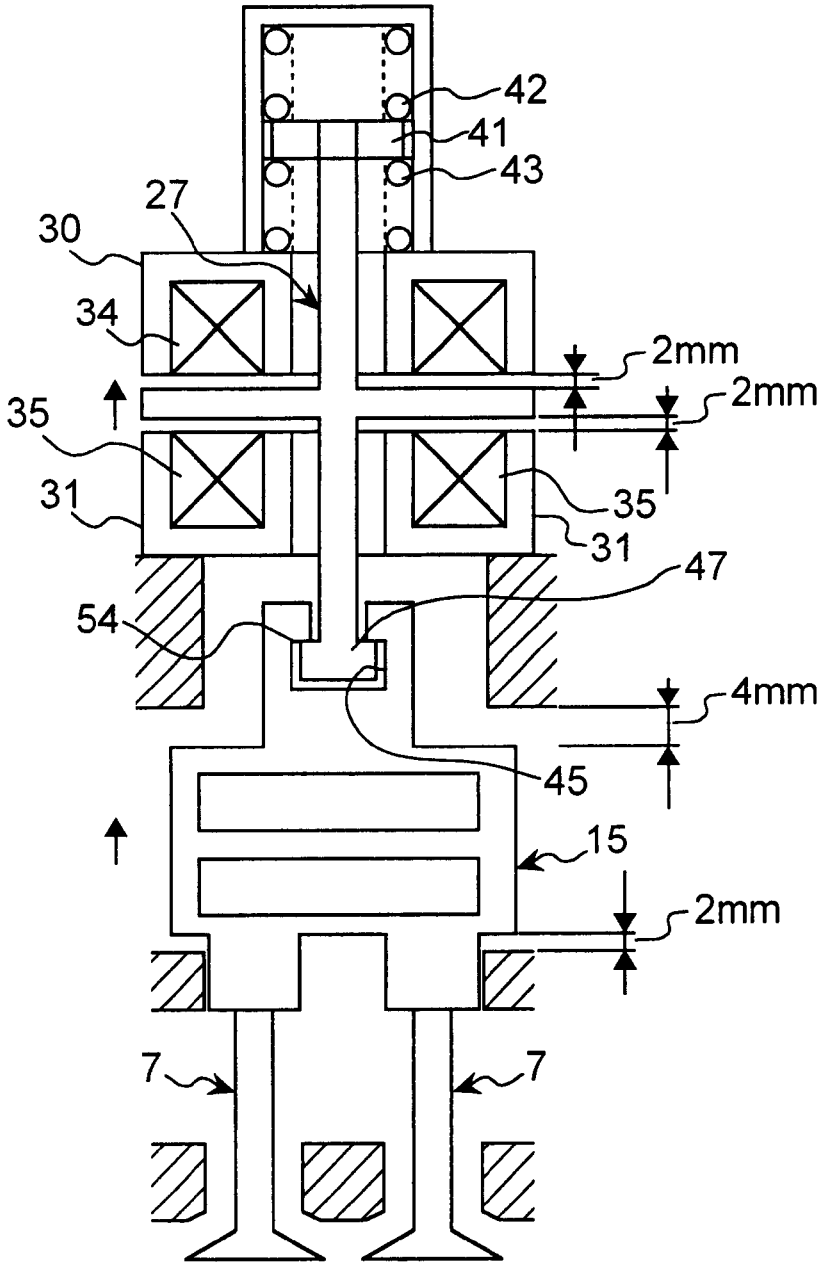
FIG. 9 is a cross section that shows the closed operation state in FIG. 3.

The other end of the first mover 15 and the other end of the second mover 27 have, respectively, a first abutting surface 53 and a second abutting surface 54. As shown, in FIG. 7, the first abutting surface 53 comprises one inner face (lower face) of the engagement hole 45, and one side (lower face) of the engagement protrusion 47. The second abutting surface 54 comprises, as shown in FIG. 9, the other inner face (upper face) of the engagement hole 45, and the other side (upper face) of the engagement protrusion 47.

The first abutting surface 53, that is, the lower face of the engagement hole 45 and the lower face of the engagement protrusion 47 abut against each other, when the second mover 27 shifts in the opening direction due to discharge of the energy by the first spring 42, to transmit the energy discharged by the first spring 42 to the inlet valve 7. The second abutting surface 54, that is, the upper face of the engagement hole 45 and the upper face of the engagement protrusion 47 abut against each other, when the second mover 27 shifts in the closing direction due to discharge of the energy by the second spring 43, to transmit the energy discharged by the second spring 43 to the inlet valve 7.

The linear actuator apparatus 9 according to the embodiment has such a configuration, and the operation thereof is explained with reference to FIGS. 5 to 10.

Explanation of the Initial State

Figure 10:
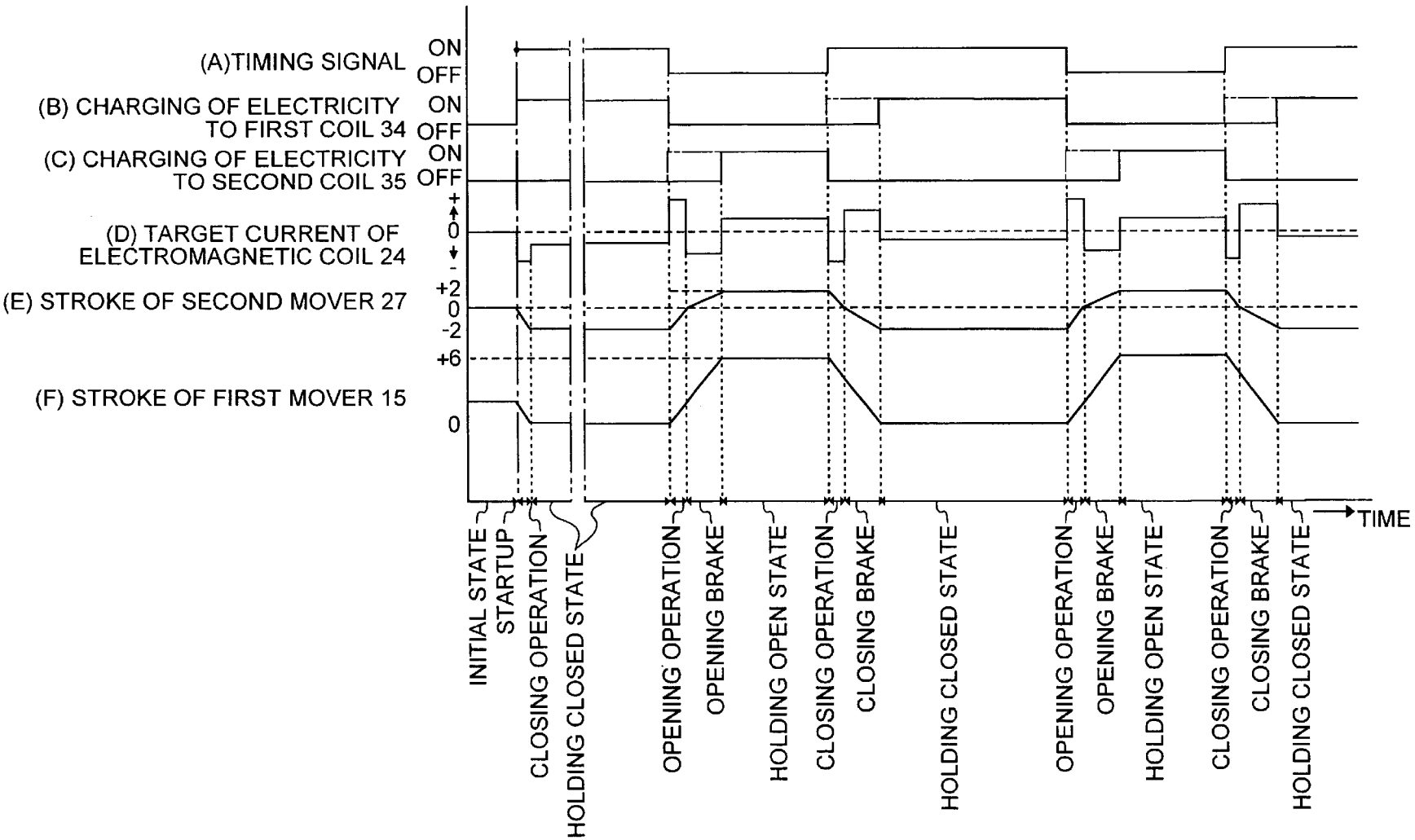
FIG. 10 is an explanatory diagram that shows the working waveform of a timing signal, charging of a first coil, charging of a second coil, target current of an electromagnetic coil, stroke of a second mover, and stroke of a first mover.

The initial state is, as shown in FIG. 5 and FIG. 10, a state in which the electric current is not supplied to the first coil 34 and the second coil 35, that is, in FIG. 10, (B) a state in which charging of electricity to the first coil 34 is OFF, and (C) charging of electricity to the second coil 35 is OFF. As a result, the first solenoid 30 and the second solenoid 31 are not magnetized, that is, in the state of being de-magnetized.

On the other hand, the upper and lower surfaces of the push plate 41 of the second mover 27 are respectively pressed by the first spring 42 and the second spring 43, which have a uniform spring force. As a result, the armature 29 of the second mover 27 is located in the intermediate position between the first solenoid 30 and the second solenoid 31. In other words, the armature 29 of the second mover 27 is located at a position where the stroke of the second mover 27 is 0, in FIG. 10 (see (E)).

Further, the initial state is a state in which an electric current is not supplied to the electromagnetic coil 24, that is, a state in which the target current of the electromagnetic coil 24 is 0 in FIG. 10 (see (D)). As a result, the first mover 15 is located at a predetermined position, that is, at a position of +2 mm of the stroke of the first mover 15 in FIG. 10 (see (F)). The valve element 26 of the inlet valve 7 integral with the first mover 15 is in a state of half open.

Further, the lower face of the engagement hole 45 of the first abutting surface 53 abuts against the lower face of the engagement protrusion 47.

Explanation of Startup, Closing Operation, and Holding Closed State

At the time of startup, when the timing signal in FIG. 10 (see (A)) is turned ON, the first coil 34 in the first solenoid 30 is energized. In other words, charging of electricity to the first coil 34 is turned ON. Further, the electromagnetic coil 24 is energized to the closed side. In other words, the target current of the electromagnetic coil 24 becomes negative.

As a result, as shown in FIG. 6, the first mover 15 shifts in the closing direction and stops, because the first stoppers 49 and 50 abut against each other. The second mover 27 also shifts in the closing direction and stops, because the first solenoid 30 absorbs the armature 29. Further, the second mover 27 shifts in the closing direction so that the upper face of the push plate 41 presses the first spring 42, and the first spring 42 is compressed to accumulate energy.

In other words, the stroke of the second mover 27 shifts from 0 to −2 (closing operation in FIG. 10). Further, the stroke of the first mover 15 shifts from +2 to 0 (closing operation in FIG. 10). As shown in FIG. 6, the valve element 26 closes the inlet port 5.

When the closed state is obtained through the startup and the closing operation, the amount of electric current to be supplied to the electromagnetic coil 24 is reduced. In other words, the target current of the electromagnetic coil 24 is brought close from a negative value to 0. As a result, the first mover 15 is retained, and the state in which the valve element 26 closes the inlet port 5 is retained (holding closed state in FIG. 10). In this closed state, the amount of electric current to be supplied to the electromagnetic coil 34 may be reduced than that at the time of startup (starting current), so as to hold the second mover 27 by this small current (holding current).

In the closed state, the inlet valve 7 can be lifted via the first mover 15, by the distance 2 mm of the relative movement in the connecting unit 13. As a result, the idling control method (Japanese Patent Application No. 2001-036795) can be executed.

Explanation of Opening Operation, Opening of Brake, and Holding Open State

When the timing signal is changed from ON to OFF, the opening operation shown in FIG. 10 starts. In other words, charging of electricity to the first coil 34 is changed from ON to OFF. The compressed first spring 42 then expands, to discharge the accumulated energy. The energy is transmitted to the first mover 15 through the second mover 27 and the first abutting surface 53. As a result, the first mover 15 is energized in the opening direction.

At the same time, the target current of the electromagnetic coil 24 is changed from a negative value close to 0 to a positive value. The second mover 27 and the first mover 15 then initially shift integrally in the opening direction (the opening operation in FIG. 10). In other words, the stroke of the second mover 27 changes from −2 to 0, and the stroke of the first mover 15 changes from 0 to +2.

As shown in FIG. 7, when the lower face of the push plate 41 abuts against the second spring 43, opening of brake in FIG. 10 starts. That is, the target current of the electromagnetic coil 24 changes from positive to negative. Further, the lower face of the push plate 41 presses the second spring 43, to compress the second spring 43, so as to accumulate energy. The opening of brake starts to act, to decelerate the shift of the second mover 27 in the opening direction, so that the first mover 15 precedes the second mover 27 in the opening direction.

As a result, the lower face of the engagement hole 45 is away from the lower face of the engagement protrusion 47, on the first abutting surface 53. In other words, the stroke of the second mover 27 changes from 0 to +2, and the stroke of the first mover 15 changes from +2 to +6. In opening the brake, the target current of the electromagnetic coil 24 is changed from positive to negative.

The upper face of the engagement protrusion 47 of the decelerated second mover 27 then abuts against the upper face of the engagement hole 45 in the preceding first mover 15. In other words, as shown in FIG. 8, the second abutting surface 54 abuts to fully open the inlet valve 7. The first mover 15 stops due to abutting of the second stoppers 51 and 52 on each other. At this time, the second coil 35 is changed from OFF to ON. The amount of electric current to be supplied to the electromagnetic coil 24 is reduced. In other words, the target current of the electromagnetic coil 24 is changed from a negative value to a positive value close to 0.

As a result, the second solenoid 31 absorbs the lower face of the armature 29, and the fully opened state of the inlet valve 7 is held (holding open state in FIG. 10). The shift speed of the first mover 15 (inlet valve 7) in the opening direction at the time of fully opening the inlet valve 7 can be adjusted, by adjusting the current to the second coil 35.

Explanation of Closing Operation, Closing of Brake, and Holding Closed State

When the timing signal is changed from OFF to ON, the closing operation shown in FIG. 10 starts. In other words, charging of electricity to the second coil 35 is changed from ON to OFF. The compressed second spring 43 then expands, to discharge the accumulated energy. The energy is transmitted to the first mover 15 through the second mover 27 and the second abutting surface 54. As a result, the first mover 15 is energized in the closing direction.

At the same time, the target current of the electromagnetic coil 24 is changed from a positive value close to 0 to a negative value. The second mover 27 and the first mover 15 then initially shift integrally in the closing direction (the closing operation in FIG. 10). In other words, the stroke of the second mover 27 changes from +2 to 0, and the stroke of the first mover 15 changes from +6 to +4.

As shown in FIG. 9, when the upper face of the push plate 41 abuts against the first spring 42, closing of brake in FIG. 10 starts. That is, the target current of the electromagnetic coil 24 changes from negative to positive. Further, the upper face of the push plate 41 presses the first spring 42, to compress the first spring 42, so as to accumulate energy. The closing of brake starts to act, to decelerate the shift of the second mover 27 in the closing direction, so that the first mover 15 precedes the second mover 27 in the closing direction.

As a result, the upper face of the engagement hole 45 is away from the upper face of the engagement protrusion 47 on the second abutting surface 54. In other words, the stroke of the second mover 27 changes from 0 to −2, and the stroke of the first mover 15 changes from +4 to 0. In closing the brake, the target current of the electromagnetic coil 24 is changed from negative to positive.

The lower face of the engagement protrusion 47 of the decelerated second mover 27 then abuts against the lower face of the engagement hole 45 in the preceding first mover 15. In other words, as shown in FIG. 6, the first abutting surface 53 abuts to fully close the inlet valve 7. The first mover 15 stops due to abutting of the first stoppers 49 and 50 on each other. At this time, the first coil 34 is changed from OFF to ON. The amount of electric current to be supplied to the electromagnetic coil 24 is reduced. In other words, the target current of the electromagnetic coil 24 is changed from a negative value to a positive value close to 0.

As a result, the first solenoid 30 absorbs the upper face of the armature 29, and the fully closed state of the inlet valve 7 is held (holding open state in FIG. 10). The shift speed of the first mover 15 (inlet valve 7) in the closing direction at the time of fully closing the inlet valve 7 can be adjusted, by adjusting the current to the first coil 34.

Thereafter, the opening operation, opening of brake, holding open state, the closing operation, closing of brake, and holding closed state are repeated, to thereby open and close the inlet valve 7 based on the predetermined time. In the action, charging of the electricity to the first coil 34 is turned ON at the time of starting holding closed state, but as shown in the chain line in FIG. 10, it may be at the time of starting the closing operation. Further, charging of the electricity to the second coil 35 is turned ON at the time of starting holding open state, but as shown in the chain line in FIG. 10, it may be at the time of starting the opening operation.

Explanation of an Example Other Than the Embodiment

The embodiment explains a configuration that works at the time of shifting in the opposite directions, that is, at the time of shifting of the inlet valve 7 in the opening direction (outward direction) and at the time of shifting thereof in the closing direction (inward direction). However, it is not limited to this configuration. The configuration may be such that the linear actuator apparatus may work at the time of shifting only in one direction, that is, at the time of shifting the load in the opening direction (outward direction) or at the time of shifting thereof in the closing direction (inward direction). In this case, as the spring, either the first spring 42 or the second spring 43 is necessary. For example, when there is the upper first spring 42, only a simple stopper instead of the lower second spring 43 can accelerate the shift of the inlet valve 7 in the opening direction, and can reduce the impact at the time of sitting of the inlet valve 7.

It is mentioned above that the second linear actuator 12 comprises the first solenoid 30 and the second solenoid 31, but it is not limited to this. The second linear actuator 12 may comprise a linear actuator other than the first solenoid 30 and the second solenoid 31.

It is mentioned above that the first spring 42 and the second spring 43 function as the first accumulator and the second accumulator. However, the accumulators may be realized with components other than the springs. Further, it is mentioned above that the first spring 42 and the second spring 43 are compression springs, but the springs could be a tension spring.

It is mentioned above that the linear actuator apparatus described in Japanese Patent Application Laid-Open No. 2000-199411 is used as the first linear actuator 11. However, a linear actuator apparatus other than the one described in Japanese Patent Application Laid-Open No. 2000-199411 may be used.

In the embodiment, the inlet valve 7 is used as the load, but in the present invention, the load may be one other than the inlet valve 7, for example, an exhaust valve or a fuel injection valve of the engine, or the like.

As is obvious from the description, according to the present invention, the accumulator efficiently accumulates or discharges the kinetic energy of the first mover and the second mover, thereby enabling a shift of the load at a high speed. After the load has started the shift, it is not necessary to supply the electric current to the second linear actuator at all times, and hence an increase of the driving energy can be suppressed. Since the accumulator can use the accumulated energy for the buffer action, the durability of the linear actuator and the load can be improved. Further, since the first mover and the second mover are connected so as to enable a relative movement thereof, and the shift of the first mover is made larger than that of the second mover, the kinetic energy can be superposed when the first mover and the second mover start to shift. Therefore, such a shift of the mover is made possible that a single linear actuator cannot handle with regard to the speed of response. As a result, the linear reciprocating movement of the load can be accelerated, and there is the effect that a linear actuator apparatus and an actuating control method, which improve the energy efficiency and the durability, can be obtained.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A linear actuator apparatus that linearly reciprocate a load, comprising:

a first linear actuator including a first mover capable of linearly reciprocating in a first direction and a second direction, the first mover being connected to the load;

a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction, wherein the shift of the first mover is larger than that of the second mover, the accumulator has a structure such that the accumulator accumulates energy by the shift of the second mover in one of the first direction and the second direction, and shifts the second mover in other one of the first direction and the second direction by discharging the accumulated energy, and the first mover and the second mover have an abutting surface, respectively, which abuts against each other when the accumulator accumulates or discharges energy, to thereby transmit energy to each other via the accumulator.

2. The linear actuator apparatus according to claim 1, wherein the second linear actuator is a solenoid that allows the second mover to shift in one direction and to be held in the shifted position, upon magnetization, and releases the held state of the second mover, upon demagnetization, and the accumulator is a spring that accumulates energy by compression or expansion due to the shift of the second mover in one of the first direction and the second direction, and shifts the second mover in other one of the first direction and the second direction by discharging energy by expansion or compression.

3. The linear actuator apparatus according to claim 1, wherein the first linear actuator comprises:

an actuating unit including a magnetic path member comprising a magnetic flux generator equipped with an electromagnetic coil by winding to generate a magnetic flux, and a magnetic field forming section having at least two pole shoes to form at least one magnetic field region by distributing the magnetic flux;

a magnetizing member fitted to the first mover and having two magnetized surfaces having a different polarity from each other; and an electric current supply unit that supplies a driving current having a magnetism corresponding to the movement of the first mover in either the first direction or the second direction, to the electromagnetic coil.

4. The linear actuator apparatus according to claim 1, wherein the load is an inlet valve, an exhaust valve, or a fuel injection valve of an engine.

5. The linear actuator apparatus according to claim 1, wherein at the time of startup, when the second linear actuator is actuated to shift the second mover, the first linear actuator is actuated to also shift the first mover in the same direction.

6. The linear actuator apparatus according to claim 1, wherein the shift of the first mover is damped by the action of the accumulator for accumulating the energy and by controlling the actuation of the second linear actuator.

7. A linear actuator apparatus that linearly reciprocate a load, comprising:

a first linear actuator including a first mover capable of linearly reciprocating in a first direction and a second direction, the first mover being connected to the load;

a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction, wherein the shift of the first mover is larger than that of the second mover, the accumulator includes a first accumulator having a structure such that it accumulates energy by the shift of the second mover in the first direction due to the operation of the second linear actuator, and shifts the second mover in the second direction by discharging the energy accumulated by the operation of the second linear actuator; and a second accumulator having a structure such that it accumulates energy by the shift of the second mover in the second direction due to the operation of the second linear actuator, and shifts the second mover in the first direction by discharging the energy accumulated by the operation of the second linear actuator, and the first mover and the second mover respectively include a first abutting surface that abuts against each other when the second mover shifts in the second direction due to the discharge of energy by the first accumulator, to transmit the energy discharged from the first accumulator to the load; and a second abutting surface that abuts against each other when the second mover shifts in the first direction due to the discharge of energy by the second accumulator, to transmit the energy discharged from the second accumulator to the load.

8. The linear actuator apparatus according to claim 7, wherein the second linear actuator comprises a first solenoid that allows the second mover to shift in the second direction and to be held in the shifted position, upon magnetization, and releases the held state of the second mover, upon demagnetization, and a second solenoid that allows the second mover to shift in the first direction and to be held in the shifted position, upon magnetization, and releases the held state of the second mover, upon demagnetization, and the first accumulator comprises a first spring that accumulates energy by compression due to the shift of the second mover in the second direction, and shifts the second mover in the first direction by discharging the energy by expansion, and the second accumulator comprises a second spring that accumulates energy by compression due to the shift of the second mover in the first direction, and shifts the second mover in the second direction by discharging the energy by expansion.

9. The linear actuator apparatus according to claim 7, wherein the first linear actuator comprises:

an actuating unit including a magnetic path member comprising a magnetic flux generator equipped with an electromagnetic coil by winding to generate a magnetic flux, and a magnetic field forming section having at least two pole shoes to form at least one magnetic field region by distributing the magnetic flux;

a magnetizing member fitted to the first mover and having two magnetized surfaces having a different polarity from each other; and an electric current supply unit that supplies a driving current having a magnetism corresponding to the movement of the first mover in either the first direction or the second direction, to the electromagnetic coil.

10. The linear actuator apparatus according to claim 7, wherein the load is an inlet valve, an exhaust valve, or a fuel injection valve of an engine.

11. The linear actuator apparatus according to claim 7, wherein at the time of startup, when the second linear actuator is actuated to shift the second mover, the first linear actuator is actuated to also shift the first mover in the same direction.

12. The linear actuator apparatus according to claim 7, wherein the shift of the first mover is damped by the action of the accumulator for accumulating the energy and by controlling the actuation of the second linear actuator.

13. An actuating control method of the linear actuator apparatus that linearly reciprocate a load, the linear actuator apparatus having a first linear actuator including a first mover capable of linearly reciprocating in a first direction and a second direction, the first mover being connected to the load;

a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction, wherein the shift of the first mover is larger than that of the second mover, the accumulator has a structure such that the accumulator accumulates energy by the shift of the second mover in one of the first direction and the second direction, and shifts the second mover in other one of the first direction and the second direction by discharging the accumulated energy, and the first mover and the second mover have an abutting surface, respectively, which abuts against each other when the accumulator accumulates or discharges energy, to thereby transmit energy to each other via the accumulator, the method comprising, at the time of startup, actuating the second linear actuator to shift the second mover in one of the first direction and the second direction and actuating the first linear actuator to shift the first mover in the same direction in which the second linear actuator is actuated.

14. An actuating control method of the linear actuator apparatus that linearly reciprocate a load, the linear actuator apparatus having a first linear actuator including a first mover capable of linearly reciprocating in a first direction and a second direction, the first mover being connected to the load;

a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction, wherein the shift of the first mover is larger than that of the second mover, the accumulator includes a first accumulator having a structure such that it accumulates energy by the shift of the second mover in the first direction due to the operation of the second linear actuator, and shifts the second mover in the second direction by discharging the energy accumulated by the operation of the second linear actuator; and a second accumulator having a structure such that it accumulates energy by the shift of the second mover in the second direction due to the operation of the second linear actuator, and shifts the second mover in the first direction by discharging the energy accumulated by the operation of the second linear actuator, and the first mover and the second mover respectively include a first abutting surface that abuts against each other when the second mover shifts in the second direction due to the discharge of energy by the first accumulator, to transmit the energy discharged from the first accumulator to the load; and a second abutting surface that abuts against each other when the second mover shifts in the first direction due to the discharge of energy by the second accumulator, to transmit the energy discharged from the second accumulator to the load, the method comprising, at the time of startup, actuating the second linear actuator to shift the second mover in one of the first direction and the second direction and actuating the first linear actuator to shift the first mover in the same direction in which the second linear actuator is actuated.

15. An actuating control method of the linear actuator apparatus that linearly reciprocate a load, the linear actuator apparatus having a first linear actuator including a first mover capable of linearly reciprocating in a first direction and a second direction, the first mover being connected to the load;

a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction, wherein the shift of the first mover is larger than that of the second mover, the accumulator has a structure such that the accumulator accumulates energy by the shift of the second mover in one of the first direction and the second direction, and shifts the second mover in other one of the first direction and the second direction by discharging the accumulated energy, and the first mover and the second mover have an abutting surface, respectively, which abuts against each other when the accumulator accumulates or discharges energy, to thereby transmit energy to each other via the accumulator, the method comprising damping the shift of the first mover by the action of the accumulator for accumulating the energy and by controlling the actuation of the second linear actuator.

16. An actuating control method of the linear actuator apparatus that linearly reciprocate a load, the linear actuator apparatus having a first linear actuator including a first mover capable of linearly reciprocating in a first direction and a second direction, the first mover being connected to the load;

a second linear actuator including a second mover capable of linearly reciprocating in the first direction and the second direction, the second mover being equipped with an accumulator; and a connecting unit that connects the first mover and the second mover so as to be able to move relative to each other linearly in the first direction and the second direction, wherein the shift of the first mover is larger than that of the second mover, the accumulator includes a first accumulator having a structure such that it accumulates energy by the shift of the second mover in the first direction due to the operation of the second linear actuator, and shifts the second mover in the second direction by discharging the energy accumulated by the operation of the second linear actuator; and a second accumulator having a structure such that it accumulates energy by the shift of the second mover in the second direction due to the operation of the second linear actuator, and shifts the second mover in the first direction by discharging the energy accumulated by the operation of the second linear actuator, and the first mover and the second mover respectively include a first abutting surface that abuts against each other when the second mover shifts in the second direction due to the discharge of energy by the first accumulator, to transmit the energy discharged from the first accumulator to the load; and a second abutting surface that abuts against each other when the second mover shifts in the first direction due to the discharge of energy by the second accumulator, to transmit the energy discharged from the second accumulator to the load, the method comprising damping the shift of the first mover by the action of the accumulator for accumulating the energy and by controlling the actuation of the second linear actuator.

* * * * *